US007025302B1

(12) United States Patent
Morkovsky

(10) Patent No.: US 7,025,302 B1
(45) Date of Patent: Apr. 11, 2006

(54) MACHINE-MOUNTED THREAD CAROUSEL FOR HOME SEWING AND EMBROIDERY MACHINES

(76) Inventor: Henry Morkovsky, 909 Wood St., Rockport, TX (US) 78382

( * ) Notice: Subject to any disclaimer, the term of this patent is extended or adjusted under 35 U.S.C. 154(b) by 0 days.

(21) Appl. No.: 10/443,268

(22) Filed: May 23, 2003

(51) Int. Cl.
*B65H 16/02* (2006.01)

(52) U.S. Cl. ..... 242/594; 242/597.7; 242/129.72; 242/136; 242/140

(58) Field of Classification Search ..... 242/594, 242/594.5, 594.6, 597.7, 129.72, 130, 134, 242/136, 140
See application file for complete search history.

(56) References Cited

U.S. PATENT DOCUMENTS 1,260,069 A * 3/1918 Sawtell ..... 242/131
2,466,852 A * 4/1949 Keith ..... 242/128
2,961,185 A * 11/1960 Seigle ..... 242/130
3,213,815 A * 10/1965 Russmann ..... 112/302
3,815,842 A * 6/1974 Scrogin ..... 242/423.1
3,822,842 A * 7/1974 Perc ..... 242/129.72
3,827,654 A * 8/1974 Armstrong ..... 242/146
4,407,461 A * 10/1983 Tomisawa ..... 242/134
5,626,302 A 5/1997 Hrobar
5,707,021 A * 1/1998 Bitts et al. ..... 242/139
5,913,485 A 6/1999 Bruffett
6,328,254 B1 12/2001 Holder
6,662,808 B1 * 12/2003 Leason et al. ..... 132/212
6,698,683 B1 * 3/2004 Young ..... 242/597.8

* cited by examiner

*Primary Examiner*—Emmanuel Marcelo

(57) ABSTRACT

This invention is a device for transporting, holding and feeding a plurality of spools of level-wound or cross-wound thread on a home sewing and/or embroidery machine. This device fits over the vertical spindle of the machine if so equipped, or over a spindle devised for the intended machine so as to provide the same function if not so equipped. It consists of a disk with a flat base, free to rotate about its vertical axis, with provisions for accepting spools of thread of various standard sizes. It can be made of any material suitable for the purpose and embodies a thread guide for each spool when used to feed cross-wound thread. It also embodies a knob, pin, ring, or other feature to enable it to be installed/removed from the machine manually without tools.

18 Claims, 4 Drawing Sheets

Machine-mounted thread carousel for home sewing and embroidery machines

Machine-mounted thread carousel for home sewing and embroidery machines

Machine-mounted thread carousel for home sewing and embroidery machines

Machine-mounted thread carousel for home sewing and embroidery machines

Machine-mounted thread carousel for home sewing and embroidery machines

MACHINE-MOUNTED THREAD CAROUSEL FOR HOME SEWING AND EMBROIDERY MACHINES

BACKGROUND OF THE INVENTION (1) Field of the Invention

This invention relates to home machine sewing and embroidery (2) Description of Related Art Home sewing machines have always been equipped with a vertical spindle to handle spools of level-wound thread. Such spools commonly rotate when in use, thus feeding thread radially. With the advent of the home embroidery and combination sewing/embroidery machines, cross-wound thread has come to the fore. Spools of cross-wound thread do not commonly rotate when in use, and thread is fed axially. It is now the norm on current embroidery-only machines for the primary spindle(s) to be horizontal and on sewing/embroidery machines for an ancillary spindle to be provided for use with level-wound thread. Also, in these machines the bobbin-winder spindle is mounted vertically on the top of the machine, and often the ancillary spindle is merely pushed over the bobbin-winder spindle. Thus, all machines have or can be provided with a vertical spindle of approximately ¼" diameter and approximately 2" height.

It has also become common for machines to have a hinged cover which must be opened to access the horizontal spindle(s) in order to sew/embroider. Many of these machines incorporate diagrams or instructions on the inside of the cover and the covers frequently not easily removable, thereby requiring thread stands residing behind the machine to have very tall thread guides in order for the thread coming from the stand to clear the cover. This, therefore, requires the operator to stand up or close the cover in order to see the color of thread next to be used and increases the thread path to the point where operators are reluctant to snip the thread, but instead stop and rewind the excessive path length of thread to the spool. If snipped at the machine's internal thread path entry point, the thread is not wasted but the end still attached to the spool risks entanglement with other such snipped threads. There are also thread stands that fasten to the machine but still but behind it, thus imparting the same or similar problems for the operator. Moving the thread stand to the side of the machine does not solve this problem but increases the thread path and consumes the already small table area normally crowded with pins, scissors, and other sewing accoutrements.

Modern sewing/embroidery machines can make use of many colors for a single design. The machine stops after embroidering a color, then the operator must thread the next color, so the proximity and clear view of the spools of thread is more important than ever.

As with Hrobar, U.S. Pat. No. 5,626,302, and Holder, U.S. Pat. No. 6,328,254, devices have been made to adapt non-standard or commercial spools to the vertical spindle of the home sewing machine, but none have addressed the use of multiple spools of standard home or non-commercial thread. At least one manufacturer has a carousel that sits adjacent to the machine on the sewing table, but it has a single tall thread guide, therefore making it imperative that the thread last used be rewound on its spool or otherwise stowed or removed from the carousel prior to feeding the next thread, else risk entanglement in the machine's balance wheel. Bruffett, U.S. Pat. No. 5,913,485, typifies the multiple-spool feature of a number of thread stands which provide a means of feeding a selected thread to the thread path of the machine, but which reside behind or beside the machine. The thread path and sight problems described in the preceding paragraph apply here.

Thread stands attached to the machine by a bracket will not support themselves when removed from the machine, and self-supporting thread stands must be heavy enough to resist toppling. This makes them unsuitable for being carried to the thread cabinet or other spool storage device where thread selection is usually made. Those residing beside the machine must have a long thread guide as well as the necessity for some weight, making it necessary to remove the guide or risk bending or breaking it if the entire assembly is carried to the thread cabinet.

BRIEF SUMMARY OF THE INVENTION

This invention is a combination spool carrier and thread feeding device for conventional and cross-wound thread alike that installs on a sewing and/or embroidery machine without tools and without modifying the machine in any way. It is light, portable, and self-supporting when dismounted, thereby enabling it to serve as a carrier of selected threads from the thread cabinet to the machine. It can be made of any material such as wood, plastic, and/or metal with equal effectiveness and can incorporate any reasonable number of spools within the parameters of spool size and machine physical characteristics. It provides the shortest thread path of any such device by virtue of its position on the top of the machine, and can be used with both level-wound and cross-wound thread. Because of the short thread path, it makes snipping the thread last used a practical alternative, thereby leaving the snipped thread ready to reenter the machine's internal thread path without any rewinding or re-inserting in the carousel's thread guide and without risking entanglement. It eases thread changes for the operator because spools are near at hand and fully visible and, because each spool has its own thread guide, it supports the feeding of more than one thread simultaneously.

DETAILED DESCRIPTION OF THE INVENTION

Figure 1:
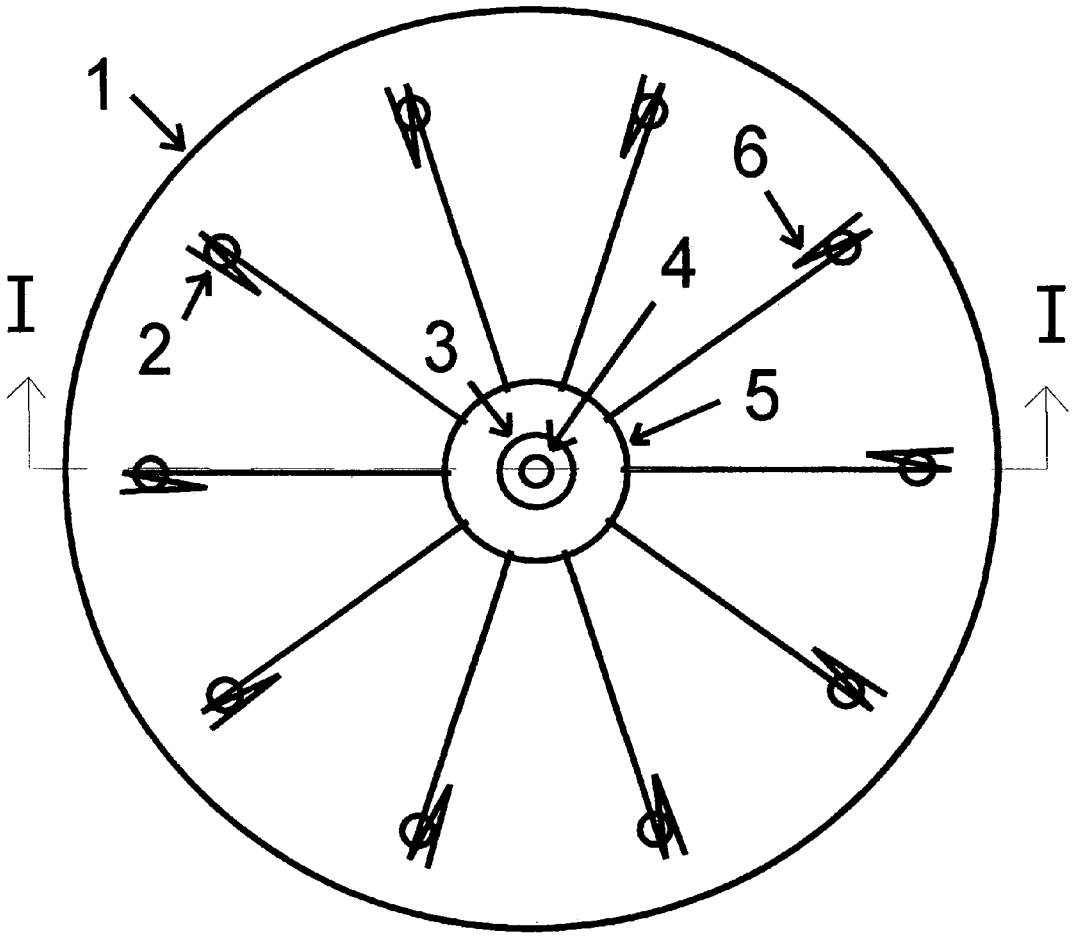
FIG. 1 is a top view of disk 1 of a typical 10-spindle wooden carousel showing spindles 2 arrayed around center dowel 3 and pinned together with dowel 4 and further showing ball 5, the lifting device which is also structural, and typical wire thread guides 6 above spindles 2. Hole 7 is the bore which accepts the vertical spindle and about which the carousel revolves.

In FIG. 1, the dimension from the outer periphery of disk 1 to the center of spindles 2 is half the diameter of the spools the carousel is designed to carry. The spacing of adjacent spindles 2 is at least the full diameter of the spools to be carried. Lifting ball 5 can be any size so long as it covers the interface between center dowel 3 and wire guides 6 (under ball 5).

Figure 2:
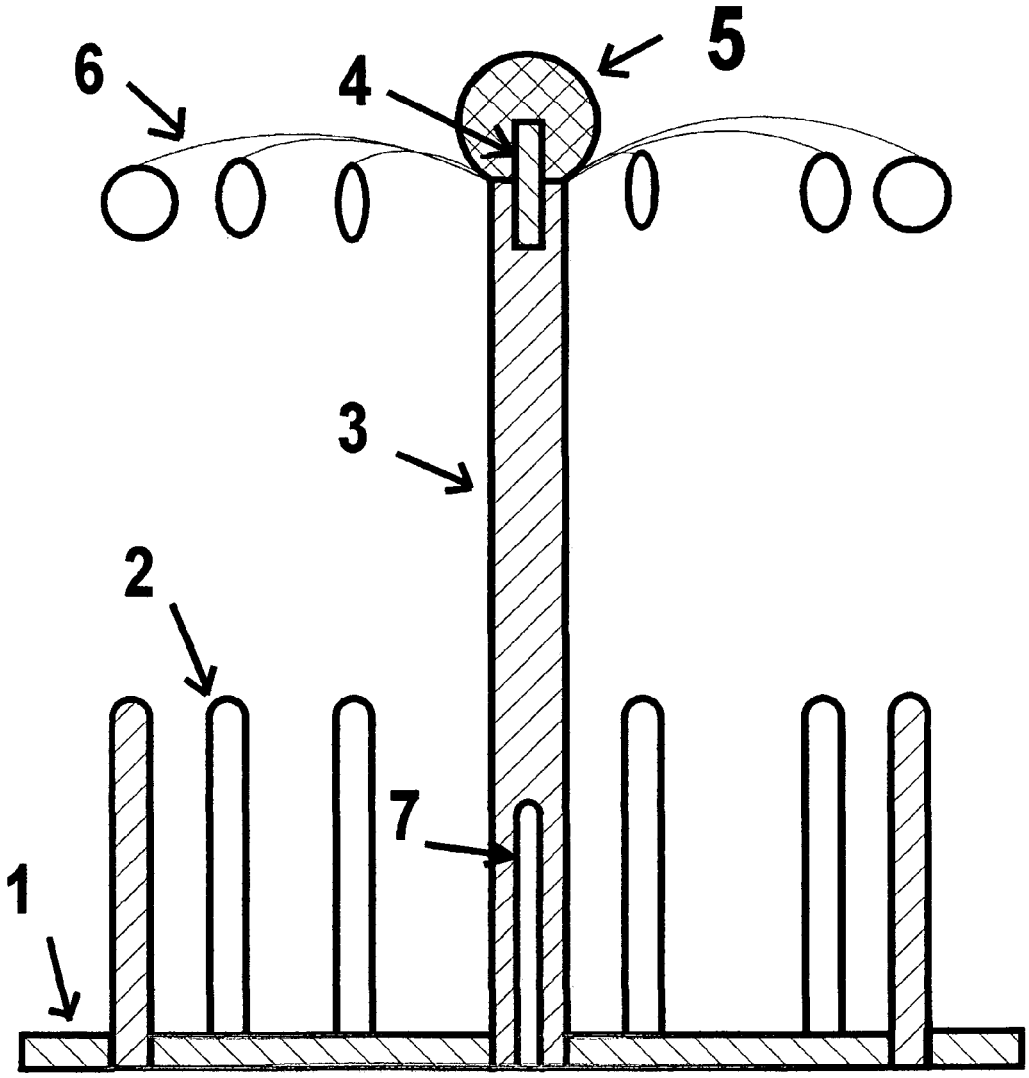
FIG. 2 is a half-section view of the same 10-spindle carousel in FIG. 1, showing the component parts fully assembled.

In FIG. 2, disk 1 of plywood or solid wood, whose outside diameter is determined by the space limitations, if any, of the intended machine is drilled to accept the number and pattern of spindles 2 as defined in FIG. 1 description. Absent machine limitations, disk 1 is sized for any number and size of spools desired. The center of disk 1 is drilled to accept dowel 3, whose height is defined by the clearance required to insert the intended size of spools between the top of spindles 2 and the bottom of guides 6. The top end of dowel 3 is notched radially for each intended guide 6. A hole is drilled ½" deep in the top of dowel 3 with a diameter equal to that of a suitably sized standard dowel 4 plus twice the diameter of the wire guides. The wires are bent and inserted in this hole and in their notches, then the pinning dowel 4 and top ball 5 are glued in place, thus permanently fixing the position of the wires directly over the spindles 2.

The bottom of dowel 3 is drilled 1⅞" deep and 17⁄64" in diameter in the bottom of dowel 3 so as to serve as a bearing for the machine spindle or ancillary machine spindle which typically measures ¼" or less in diameter and 2" high. It is not necessary for the machine/ancillary spindle to bottom out in this hole because the base of the carousel can be used as a bearing surface. If some protrusion on the intended machine interferes, a collar or shim is slipped over the machine/ancillary spindle to raise the carousel disk above the interfering protrusion.

Figure 3:
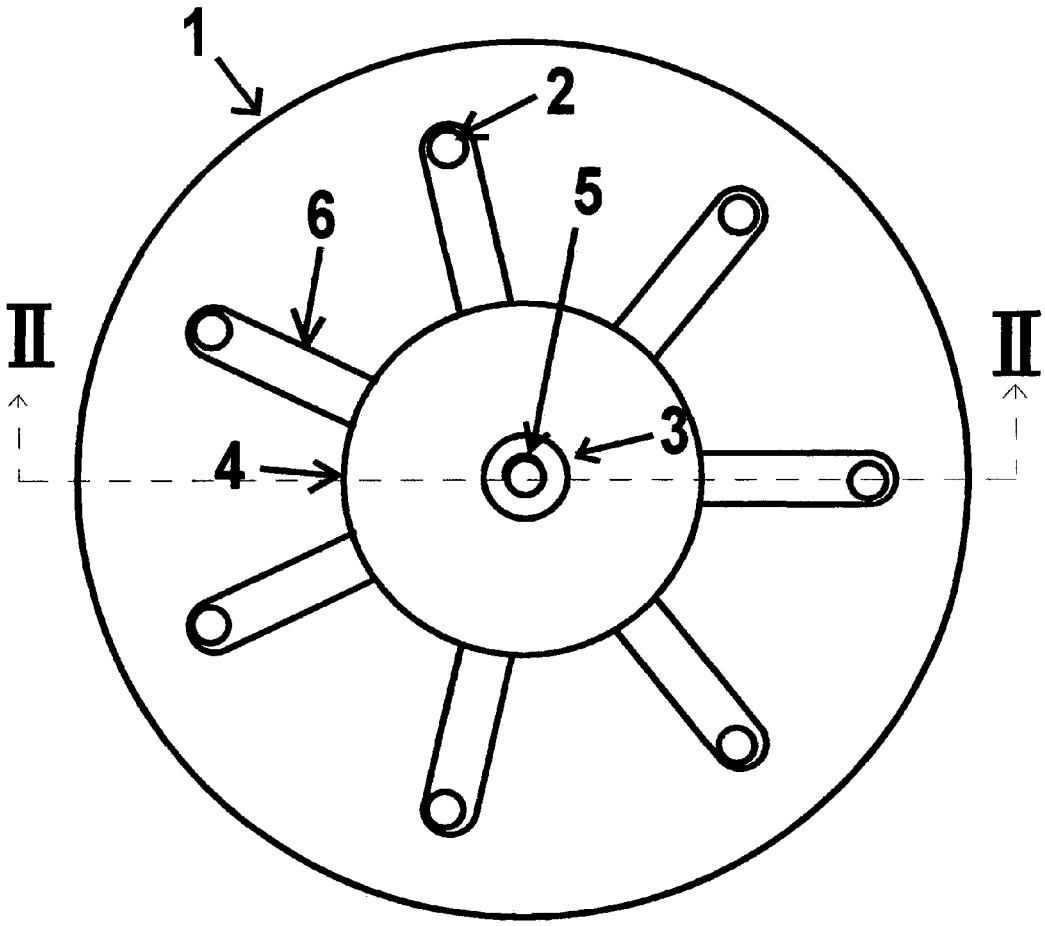
FIG. 3 is a top view of a typical 7-spindle carousel injection molded of acrylic plastic showing spindles 2 arrayed around center shaft 3 and lifting pin 5. Typical wire guides 6 are embedded in the periphery of disk 4 and above spindles 2 (disk 4 is a separate component of the assembly due to limitations of molding technology.

In FIG. 3, the dimension from the outer periphery of disk 1 to the center of spindles 2 is half the diameter of the spools the carousel is designed to carry. The spacing of adjacent spindles 2 is at least the full diameter of the spools to be carried. Disk 4 can be any diameter as long as guides can be fastened in its periphery or otherwise suspended from the functional equivalent of disk 4.

Figure 4:
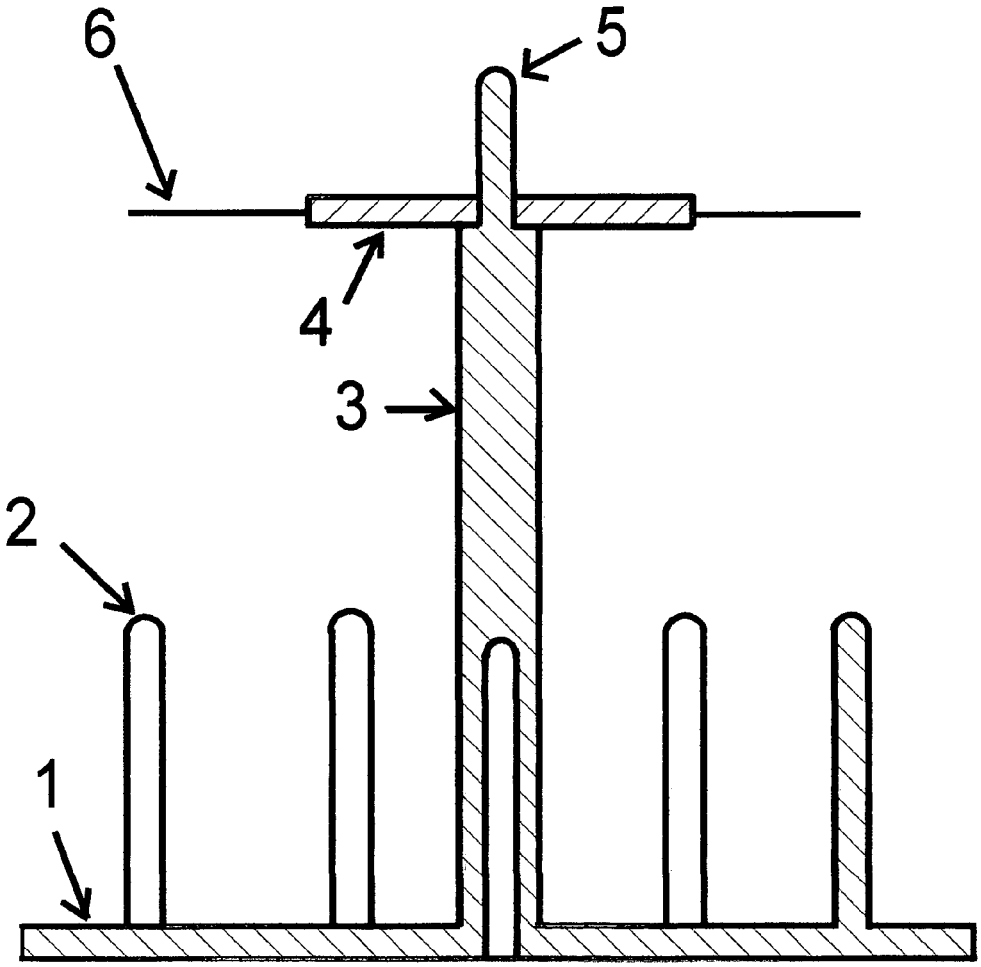
FIG. 4 is a half-section view of the 7-spindle carousel shown in FIG. 3.

In FIG. 4, disk 1 of acrylic plastic, whose outside diameter is determined by the space limitations, if any, of the intended machine is molded with spindles 2 as defined in FIG. 3 description. Absent machine limitations, disk 1 is sized for any number and size of spools desired. The center. A ¼" diameter hole 1⅞" deep is at the lower end of shaft, and disk 4 is bonded to shaft. Guides 6 are bonded to disk 4 to fit the spindle pattern.

These embodiments illustrate that this invention is based not on choices of materials or dimensions or method of construction, but has as its root principle a light, compact carrying/feeding device mountable on any sewing/embroidery machine without tools and not requiring any change to the structure of the machine. Variations such as a telescoping center shaft to ease stowage or a cast, formed, or blow-molded version with integral guides fall within the scope of this invention.

I claim:

1. A light, portable thread spool carousel for carrying/feeding thread that mounts on a sewing and/or embroidery machine, comprising:

a horizontal disk with spindles for a plurality of spools of thread;

a vertical spindle centered in the disk with thread guides attached, one for each spool spindle on the disk; and a bore in the bottom of the spindle at the axis of the carousel to serve as a bearing for the spindle on which the carousel is mounted and about which it can rotate.

2. The carousel of claim 1, further comprising a knob, pin, or ring to serve as a lifting device to install/remove the carousel from the machine.

3. The carousel of claim 1, wherein the horizontal disk has a flat base, enabling the disk to support the plurality of spools in an upright manner when the carousel is not mounted on the sewing and/or embroidery machine.

4. The carousel of claim 1, wherein the diameter of the disk is based upon the size and construction of a machine that receives the carousel and the number of spools is determined by the size of the spools and the diameter of the disk.

5. The carousel of claim 1, wherein the carousel is able to be mounted such that the a machine on which the carousel is mounted has the same foot print as the machine when the carousel is not mounted.

6. The carousel of claim 1, wherein the carousel installs on a machine without tools and does not require modifications to the machine upon which the carousel is mounted.

7. A sewing machine, comprising:

a spindle; and a light, portable thread spool carousel for carrying/feeding thread that fits over the spindle, comprising:

a horizontal disk with spindles for a plurality of spools of thread;

a vertical spindle centered in the disk with thread guides attached, one for each spool spindle on the disk; and a bore in the bottom of the spindle at the axis of the carousel to serve as a bearing for the spindle on which the carousel is mounted and about which it can rotate.

8. The sewing machine of claim 7, the carousel further comprising a knob, pin, or ring to serve as a lifting device to install/remove the carousel from the machine.

9. The sewing machine of claim 7, wherein the horizontal disk has a flat base, enabling the disk to support the plurality of spools in an upright manner when the carousel is not mounted on the sewing machine.

10. The sewing machine of claim 7, wherein the diameter of the disk is based upon the size and construction of the sewing machine and the number of spools is determined by the size of the spools and the diameter of the disk.

11. The sewing machine of claim 7, wherein the sewing machine has the same foot print when the carousel is mounted on the sewing machine as when the carousel is not mounted.

12. The sewing machine of claim 7, wherein the carousel installs on the sewing machine without tools.

13. An embroidery machine, comprising:

a spindle; and a light, portable thread spool carousel for carrying/feeding thread that fits over the spindle, comprising:

a horizontal disk with spindles for a plurality of spools of thread;

a vertical spindle centered in the disk with thread guides attached, one for each spool spindle on the disk; and a bore in the bottom of the spindle at the axis of the carousel to serve as a bearing for the spindle on which the carousel is mounted and about which it can rotate.

14. The embroidery machine of claim 13, the carousel further comprising a knob, pin, or ring to serve as a lifting device to install/remove the carousel from the machine.

15. The embroidery machine of claim 13, wherein the horizontal disk has a flat base, enabling the disk to support the plurality of spools in an upright manner when the carousel is not mounted on the embroidery machine.

16. The embroidery machine of claim 13, wherein the diameter of the disk is based upon the size and construction of the embroidery machine and the number of spools is determined by the size of the spools and the diameter of the disk.

17. The embroidery machine of claim 13, wherein the sewing machine has the same foot print when the carousel is mounted on the sewing machine as when the carousel is not mounted.

18. The embroidery machine of claim 13, wherein the carousel installs on the sewing machine without tools and does not require modifications to the sewing machine.

* * * * *